US008385579B2

(12) United States Patent
Wang et al.

(10) Patent No.: US 8,385,579 B2
(45) Date of Patent: Feb. 26, 2013

(54) DIAPHRAGM AND LOUDSPEAKER USING THE SAME

(75) Inventors: Jia-Ping Wang, Beijing (CN); Liang Liu, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 269 days.

(21) Appl. No.: 12/824,390

(22) Filed: Jun. 28, 2010

(65) Prior Publication Data

US 2011/0026758 A1 Feb. 3, 2011

(30) Foreign Application Priority Data

Jul. 31, 2009 (CN) ..... 2009 1 0108863

(51) Int. Cl.
*H04R 1/02* (2006.01)

(52) U.S. Cl. ..... 381/394; 977/742; 977/949

(58) Field of Classification Search ..... 977/742, 977/902, 949; 381/394, 423
See application file for complete search history.

(56) References Cited

U.S. PATENT DOCUMENTS

| | | | | |
|---|---|---|---|---|
| 4,312,118 | A | 1/1982 | Saik et al. | |
| 6,597,798 | B1 * | 7/2003 | Nakazono et al. | 381/410 |
| 6,639,993 | B2 * | 10/2003 | Kemmerer et al. | 381/397 |
| 6,808,746 | B1 | 10/2004 | Dai et al. | |
| 7,045,108 | B2 | 5/2006 | Jiang et al. | |
| 8,068,626 | B2 * | 11/2011 | Jiang et al. | 381/164 |
| 8,073,164 | B2 * | 12/2011 | Jiang et al. | 381/164 |
| 2004/0020681 | A1 | 2/2004 | Hjortstam et al. | |
| 2004/0053780 | A1 | 3/2004 | Jiang et al. | |
| 2008/0248235 | A1 | 10/2008 | Feng et al. | |
| 2008/0260188 | A1 * | 10/2008 | Kim | 381/190 |
| 2008/0299031 | A1 | 12/2008 | Liu et al. | |
| 2008/0304694 | A1 | 12/2008 | Hayashi | |
| 2009/0045005 | A1 * | 2/2009 | Byon et al. | 181/167 |
| 2009/0068448 | A1 | 3/2009 | Liu et al. | |
| 2009/0074228 | A1 | 3/2009 | Mango, III et al. | |
| 2009/0153502 | A1 | 6/2009 | Jiang et al. | |
| 2009/0155467 | A1 | 6/2009 | Wang et al. | |
| 2009/0160799 | A1 | 6/2009 | Jiang et al. | |
| 2009/0197082 | A1 | 8/2009 | Jiang et al. | |
| 2009/0268559 | A1 * | 10/2009 | Jiang et al. | 367/140 |
| 2009/0272935 | A1 | 11/2009 | Hata et al. | |

(Continued)

FOREIGN PATENT DOCUMENTS

| | | |
|---|---|---|
| CN | 2282253 | 5/1998 |
| CN | 2488247 | 4/2002 |

(Continued)

OTHER PUBLICATIONS

"Flexible, Stretchable, Transparent Carbon Nanotube Thin Film Loudspeakers" Lin Xiao et al. Nano Letters, Oct. 29, 2008.*

(Continued)

*Primary Examiner* — Jeffrey Donels
(74) *Attorney, Agent, or Firm* — Altis Law Group, Inc.

(57) ABSTRACT

A diaphragm includes a membrane and at least one reinforcing structure stacked on the membrane. The at least one reinforcing structure includes at least one free-standing carbon nanotube structure. The at least one free-standing carbon nanotube structure includes a net structure of a plurality of carbon nanotubes combined to each other due to the van der Waals attractive force. A loudspeaker using the diaphragm is also disclosed.

20 Claims, 16 Drawing Sheets

U.S. PATENT DOCUMENTS

| | | | | |
|---|---|---|---|---|
| 2009/0296528 | A1* | 12/2009 | Jiang et al. | 367/140 |
| 2010/0046784 | A1* | 2/2010 | Jiang et al. | 381/386 |
| 2010/0188934 | A1* | 7/2010 | Qian et al. | 367/140 |

FOREIGN PATENT DOCUMENTS

| | | |
|---|---|---|
| CN | 1430785 | 7/2003 |
| CN | 2583909 | 10/2003 |
| CN | 1640923 | 7/2005 |
| CN | 101239712 | 8/2008 |
| CN | 101288336 | 10/2008 |
| CN | 101321410 | 12/2008 |
| CN | 101381071 | 3/2009 |
| CN | 101464759 | 6/2009 |
| JP | 60-27298 | 2/1985 |
| JP | 63-49991 | 12/1988 |
| JP | 7-138838 | 5/1995 |
| JP | 2002-171593 | 6/2002 |
| JP | 2002-542136 | 12/2002 |
| JP | 2003-319490 | 11/2003 |
| JP | 2004-32425 | 1/2004 |
| JP | 2004-107196 | 4/2004 |
| JP | 2006-147801 | 6/2006 |
| JP | 2007-182352 | 7/2007 |
| JP | 2007-290908 | 11/2007 |
| JP | 2009-144158 | 7/2009 |
| JP | 2009-146420 | 7/2009 |
| JP | 2009-184910 | 8/2009 |
| WO | W02007015710 | 2/2007 |

OTHER PUBLICATIONS

"Nanotubes made of carbon find an unexpected use." The Economist, Nov. 20, 2008.*

"Hot nanotube sheets produce music on demand." New Scientist, Oct. 31, 2008.*

Xiao et al.,Flexible, Stretchable, Transparent Carbon Nanotube Thin Film Loudspeakers,Nanoletter, vol. 8; No. 12, 4539-4545.

* cited by examiner

DIAPHRAGM AND LOUDSPEAKER USING THE SAME

CROSS-REFERENCE TO RELATED APPLICATIONS

This application claims all benefits accruing under 35 U.S.C. §119 from China Patent Application No. 200910108863.X, filed on 2009 Jul. 31, in the China Intellectual Property Office, the contents of which are hereby incorporated by reference. This application is related to commonly-assigned application entitled, "DIAPHRAGM AND LOUDSPEAKER USING THE SAME", filed on Jun. 28, 2010, Ser. No. 12/824,386.

BACKGROUND

1. Technical Field

The present disclosure relates to diaphragms and loudspeakers and, particularly, to a diaphragm based on carbon nanotubes and a loudspeaker using the same.

2. Description of Related Art

A loudspeaker is an acoustic device transforming received electric signals into sounds. There are different types of loudspeakers that can be categorized accordingly to their working principle, such as electro-dynamic loudspeakers, electromagnetic loudspeakers, electrostatic loudspeakers and piezoelectric loudspeakers. Among the various types, the electro-dynamic loudspeakers have simple structures, good sound qualities, low costs, and are most widely used.

The electro-dynamic loudspeaker typically includes a diaphragm, a bobbin, a voice coil, a damper, a magnet, and a frame. The voice coil is an electrical conductor, and is placed in the magnetic field of the magnet. By applying an electrical current to the voice coil, a mechanical vibration of the diaphragm is produced due to the interaction between the electromagnetic field produced by the voice coil and the magnetic field of the magnets, thus sound waves are produced by kinetically pushing the air. The diaphragm reproduces the sound pressure waves, corresponding to the original input electric signals.

To evaluate the loudspeaker, sound volume is a decisive factor. The sound volume of the loudspeaker relates to the input power of the electric signals and the conversion efficiency of the energy. However, when the input power is increased to certain levels, the typical diaphragm could deform or even break, thereby causing audible distortion.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
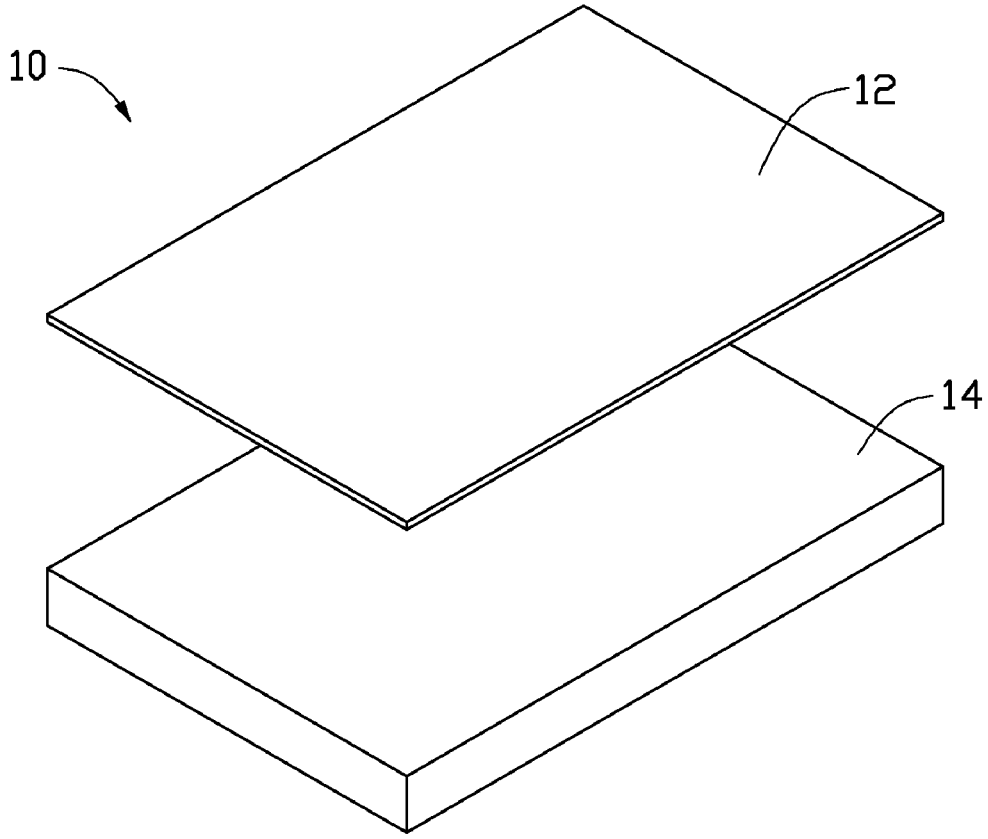
FIG. 1 is a schematic structural view of an embodiment of a diaphragm including one carbon nanotube film.

Referring to FIG. 1, a first embodiment of a diaphragm 10 includes a membrane 14 and one or more reinforcing structures 12. The reinforcing structures 12 are disposed on at least one surface of the membrane 14. Although the diaphragm 10 shown in FIG. 1 is rectangular, the diaphragm 10 can be cut into other shapes, such as circular, elliptical, or triangular, to adapt to actual needs of a desired loudspeaker design. The shape of the diaphragm 10 is not limited.

The membrane 14 can be a cone diaphragm, bullet-proof cloth diaphragm, polypropylene diaphragm or carbon fiber diaphragm. The material of the membrane 14 can be metal, diamond, ceramic, paper, cellulose, cloth or polymer. The polymer can be polypropylene, polyethylene terephthalate (PET), polyetherimide (PEI), polyethylene naphthalate (PEN), polyphenylene sulfide (PPS), polyvinyl chloride (PVC), polystyrene (PS), or polyethersulfone (PES). The material of the membrane 14 can also be glass fiber, BAKELITE, silk fiber, expanded polystyrene (EPS) or expanded plastic. The membrane 14 can be made of one or more materials. Although the membrane 14 shown in FIG. 1 is rectangular, the membrane 14 can be cut into other shapes, such as round, elliptical, or triangular, to adapt to actual needs of a loudspeaker design. The shape of the membrane 14 is not limited.

The reinforcing structure 12 is a freestanding structure, and includes a plurality of carbon nanotubes. The term "freestanding structure" includes, but is not limited to, a structure that does not have to be supported by a substrate. For example, a freestanding structure can sustain the weight of itself when it is hoisted by a portion thereof without any significant damage to its structural integrity. The carbon nanotubes are combined to each other due to the van der Waals attractive force, thereby forming a net structure, and enable a shape of the reinforcing structure 12. In the reinforcing structure 12, the carbon nanotubes are orderly or disorderly aligned. The disorderly aligned carbon nanotubes are carbon nanotubes arranged along many different directions, such that the number of carbon nanotubes arranged along each different direction can be almost the same (e.g. uniformly disordered); and/or entangled with each other. The orderly aligned carbon nanotubes are carbon nanotubes arranged in a consistently systematic manner, e.g., most of the carbon nanotubes are arranged approximately along a same direction or have two or more sections within each of which the most of the carbon nanotubes are arranged approximately along a same direction (different sections can have different directions). The thickness of the reinforcing structure 12 can be in a range from about 0.5 nanometers to about 1 millimeter. The carbon nanotubes in the reinforcing structure 12 can be selected from single-walled, double-walled, and/or multi-walled carbon nanotubes. Diameters of the single-walled carbon nanotubes approximately range from 0.5 nanometers to 50 nanometers. Diameters of the double-walled carbon nanotubes approximately range from 1 nanometer to 50 nanometers. Diameters of the multi-walled carbon nanotubes approximately range from 1.5 nanometers to 50 nanometers. In one embodiment, most of the carbon nanotubes in the reinforcing structure 12 are aligned along the same direction. The reinforcing structure 12 can be directly attached on the membrane 14 via the adhesive nature of the reinforcing structure 12 in some embodiments. The reinforcing structure 12 can also be attached on the membrane 14 via adhesive. Further, it is noteworthy that some carbon nanotubes of the reinforcing structure 12 can permeate or be inserted into the membrane 14, so that the reinforcing structure 12 and the membrane 14 are firmly combined together.

Figure 2:
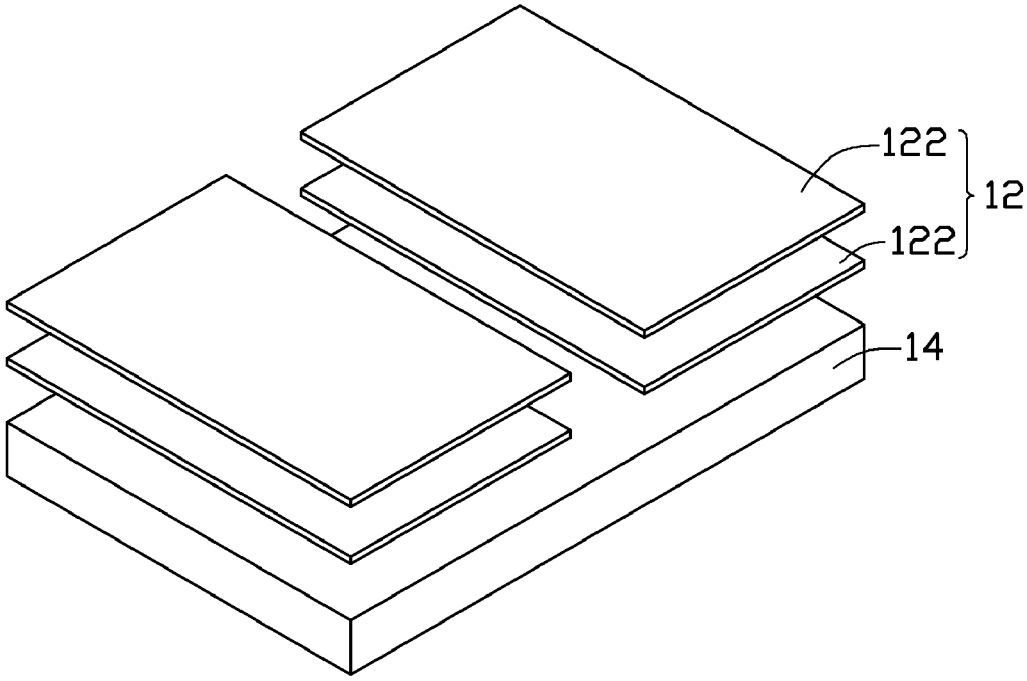
FIG. 2 is a schematic structural view of another embodiment of a diaphragm including two or more carbon nanotube films.

In the first embodiment, the reinforcing structure 12 is a free-standing carbon nanotube structure. The carbon nanotube structure can have a planar shape or a linear shape. The carbon nanotube structure consists of a plurality of uniformly distributed carbon nanotubes. The carbon nanotubes are combined by van der Waals attractive force therebetween. It is noteworthy that the carbon nanotube structure can be seen as a substantially pure structure consisting mostly of carbon nanotubes, and the carbon nanotubes can only include carbon elements. The carbon nanotube structure can be one or more carbon nanotube films, one or more carbon nanotube wire structures, or the combination thereof. The carbon nanotube wire structure includes at least one carbon nanotube wire. If the carbon nanotube wire structure includes a plurality of carbon nanotube wires, the carbon nanotube wires can be substantially parallel to each other to form a bundle-like structure or twisted with each other to form a twisted structure. The bundle-like structure and the twisted structure are two kinds of linear shaped carbon nanotube structure. The plurality of carbon nanotube wire structures can be woven together to form a planar shaped carbon nanotube structure. Referring to FIG. 2, when the carbon nanotube structure includes a plurality of carbon nanotube films 122, the plurality of carbon nanotube films 122 can be stacked together and/or coplanar arranged to form the planar shaped carbon nanotube structure.

More specifically, the reinforcing structure 12 and the membrane 14 can be combined together in the following manner.

The carbon nanotube structure can include at least one carbon nanotube film 122. Referring to FIG. 2, the plurality of carbon nanotube films 122 can be stacked together or coplanar arranged on one side of the membrane 14. The plurality of carbon nanotube films 12 can be in contact with each other or spaced from each other on the membrane 14.

The carbon nanotube structure can include at least one carbon nanotube wire structure. The carbon nanotube wire structure can be distributed over the entire surface of the membrane 14, or selectively arranged at areas on the membrane 14 in need of reinforcement.

Figure 3:
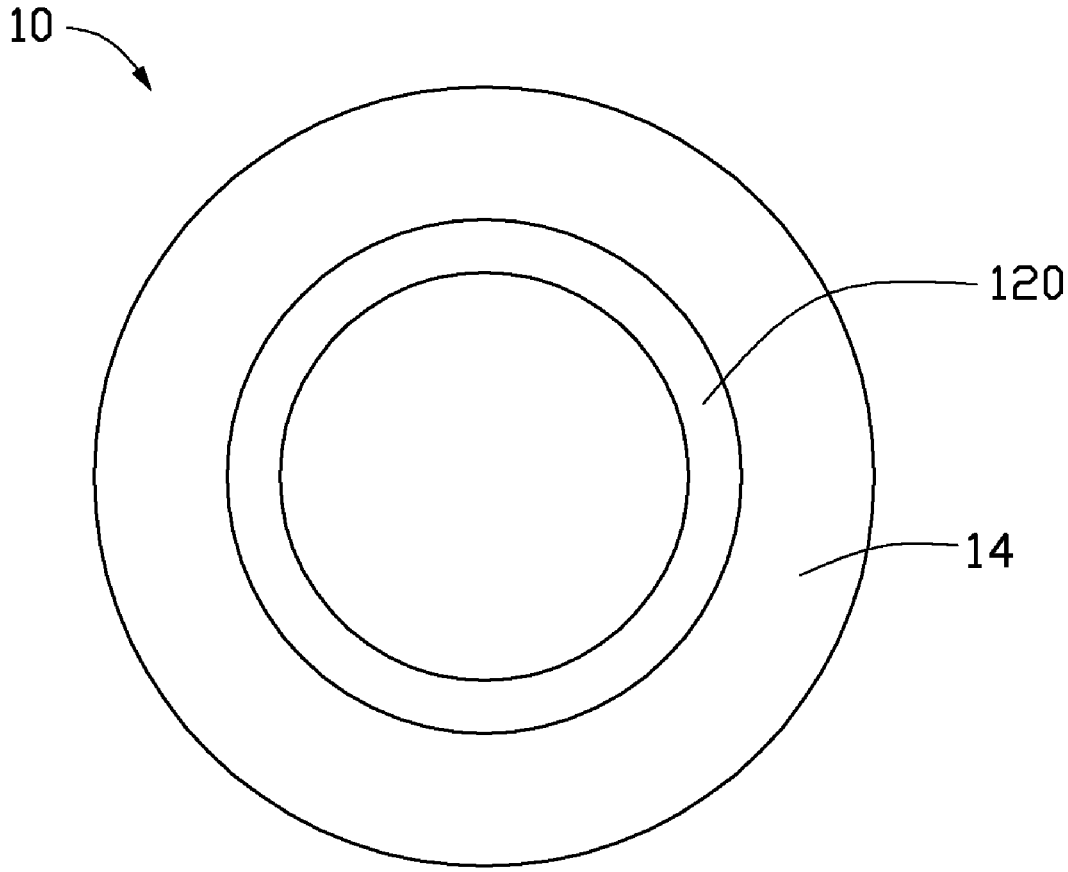
FIG. 3 is a schematic top view of another embodiment of a diaphragm including a circle shaped carbon nanotube wire structure.

Referring to FIG. 3, the carbon nanotube wire structure 120 can be deformed to form a circle and can be disposed on a central area of the surface of the membrane 14. The circular carbon nanotube wire structure 120 is concentric with the round membrane 14.

Figure 4:
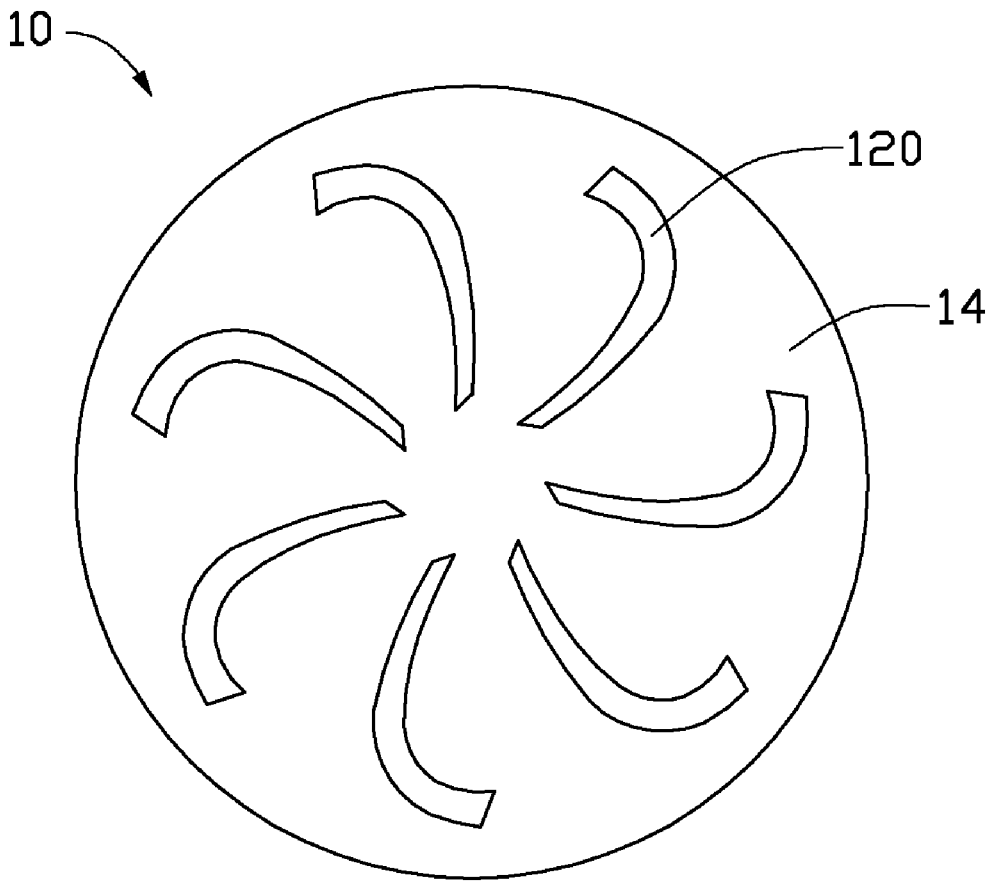
FIG. 4 is a schematic top view of another embodiment of a diaphragm including radiated arranged carbon nanotube wire structures.

Referring to FIG. 4, the diaphragm 10 can include a plurality of carbon nanotube wire structures 120 arranged to radiate from the center of the round membrane 14. The carbon nanotube wire structures 120 can be straight or curved.

It is noteworthy that the arrangement of the carbon nanotube wire structures 120 is not limited to the above-mentioned manners. For example, the diaphragm 10 can include a spiral shaped carbon nanotube wire structure 120 on the surface of the membrane 14. The carbon nanotube wire structure 120 can increase the strength and the Young's modulus, especially in the certain location of the diaphragm 10 that needs reinforcement.

Figure 5:
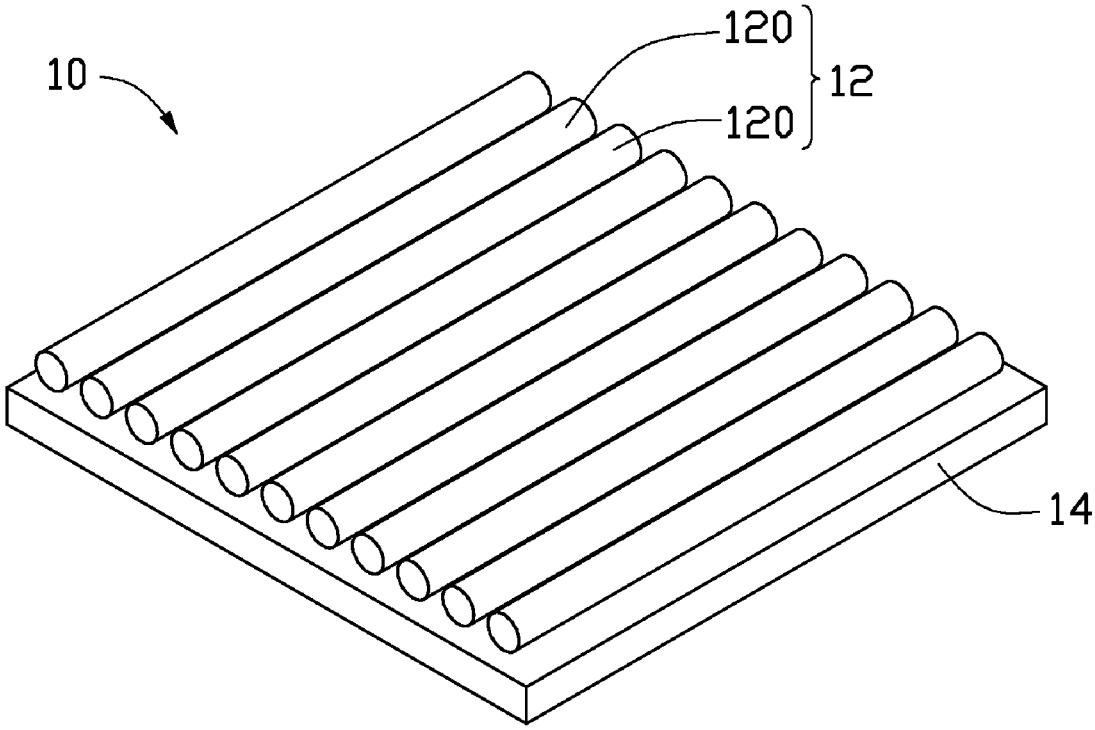
FIG. 5 is a schematic structural view of another embodiment of a diaphragm including a plurality of carbon nanotube wire structures parallel to each other.
Figure 6:
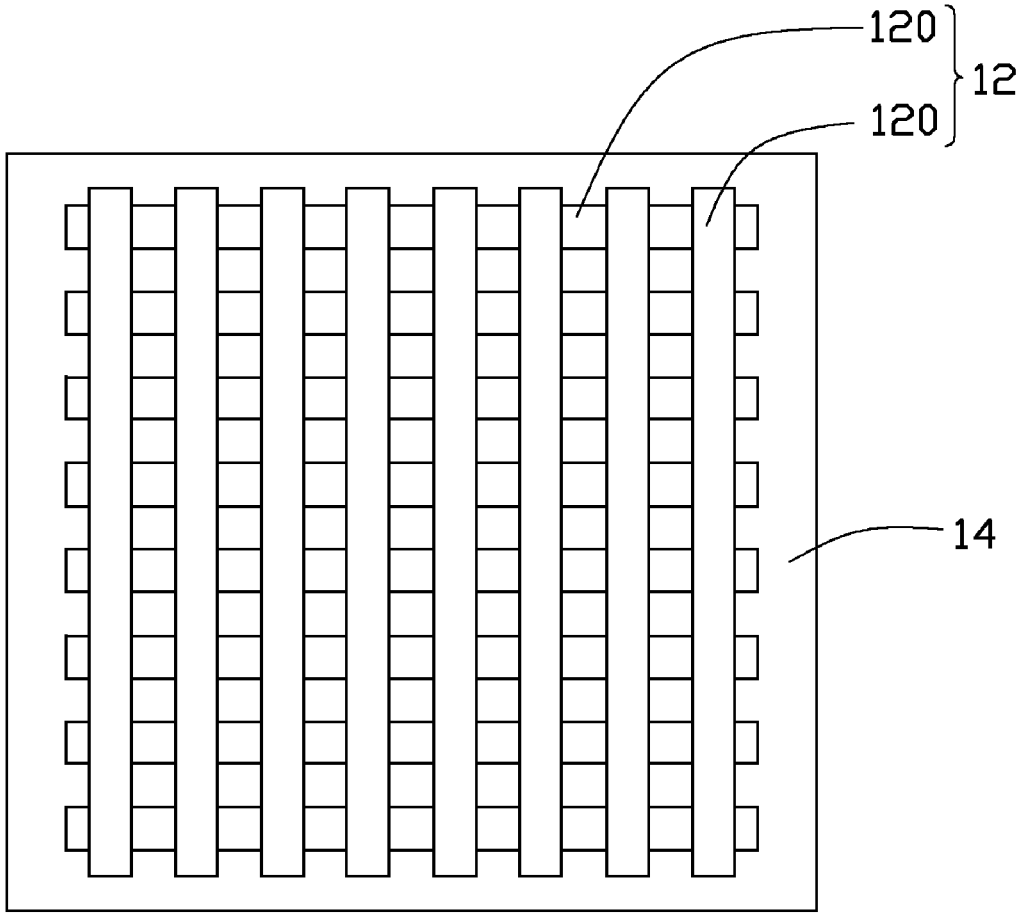
FIG. 6 is a schematic top view of another embodiment of a diaphragm including two groups of carbon nanotube wire structures crossed to each other.
Figure 7:
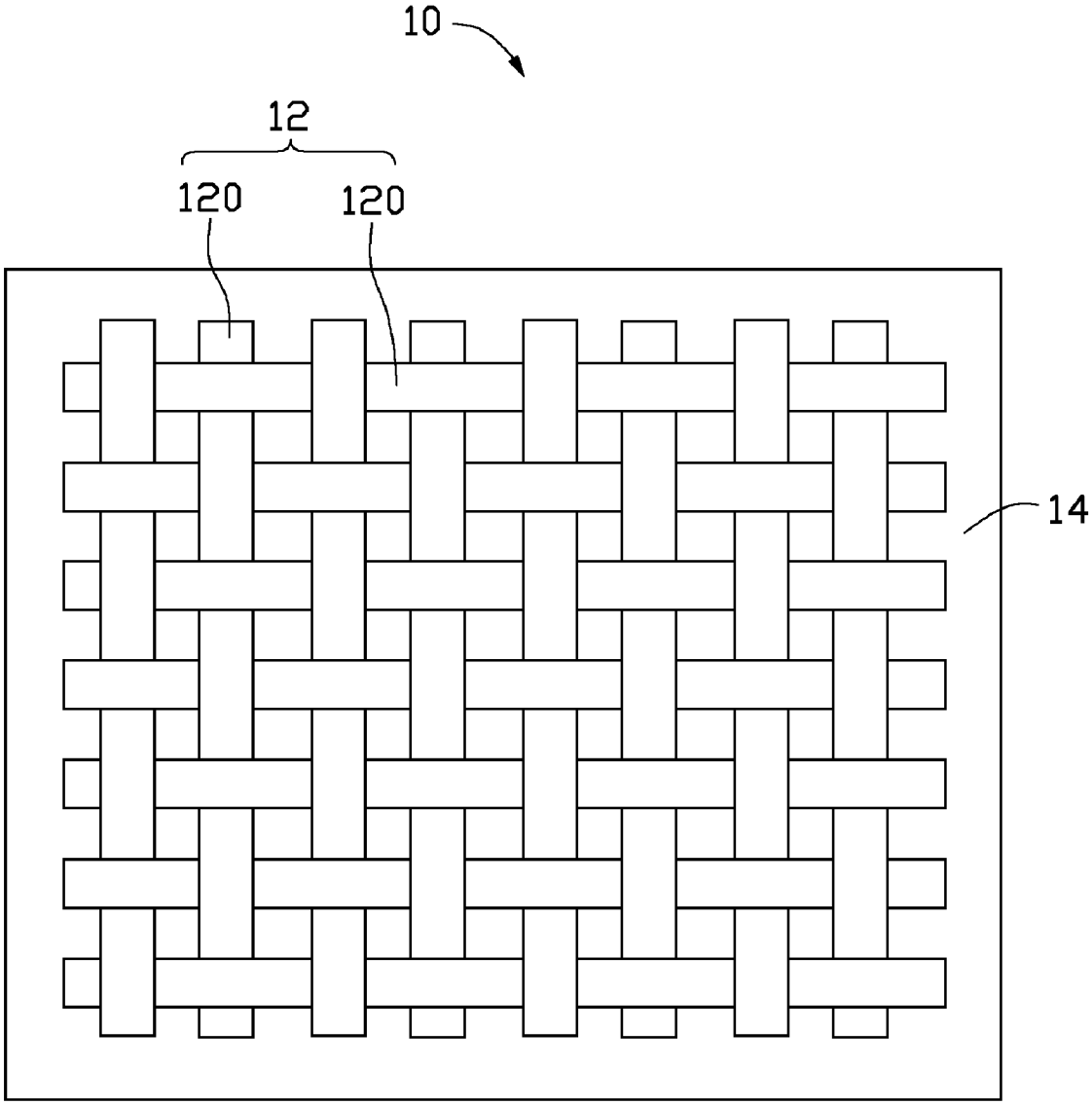
FIG. 7 is a schematic top view of another embodiment of a diaphragm including a plurality of carbon nanotube wire structures woven together.

Referring to FIG. 5, FIG. 6 and FIG. 7, the carbon nanotube structure can include a plurality of carbon nanotube wire structures 120. The plurality of carbon nanotube wire structures 120 can be substantially parallel to each other, crossed with each other, or woven together, and cover the surface of the membrane 14. As shown in FIG. 5, the carbon nanotube wire structures 120 are substantially parallel to each other and closely arranged to form at least one layer covering the surface of the membrane 14 and contact adjacent ones. The axes of the carbon nanotube wire structures 120 are oriented in the same direction. As shown in FIG. 6, some of the carbon nanotube wire structures 120 are arranged substantially in parallel at regular intervals to form a first layer covering the surface of the membrane 14, and some of the carbon nanotube wire structures 120 are arranged substantially in parallel at regular intervals to form a second layer covering the first layer. The axes of the carbon nanotube wire structures 120 in the first layer are oriented to a first direction, and the axes of the carbon nanotube wire structures 120 in the second layer are oriented to a second direction which is substantially perpendicular to the first direction. It is noteworthy that the plurality of carbon nanotube wire structure 120 can be woven to form a carbon nanotube cloth. The carbon nanotube cloth is a planar shaped carbon nanotube structure which can be used in the diaphragm 10.

The carbon nanotube structure can have a size approximately equal to the membrane 14. The carbon nanotube structure can also be patterned or cut into different shapes, and arranged on the membrane 14.

The reinforcing structure 12 can include the combination of the carbon nanotube film 122 and the carbon nanotube wire structure 120. The substantially parallel, crossed, or woven carbon nanotube wire structures 120 can be arranged on a surface of the carbon nanotube film 122 or sandwiched by two carbon nanotube films 122.

If the membrane 14 is made of polymer, the membrane 14 and the reinforcing structure 12 can be treated by hot pressing after the reinforcing structure 12 is disposed on the membrane 14. After hot pressing, the reinforcing structure 12 and the membrane 14 are firmly combined together. If the reinforcing structure 12 is directly attached on the membrane 14, some carbon nanotubes of the reinforcing structure 12 will permeate or insert into the membrane 14 after hot pressing. If the reinforcing structure 12 is attached on the membrane 14 via adhesive, some carbon nanotubes of the reinforcing structure 12 will permeate or insert into the adhesive after hot pressing.

The carbon nanotube film can be a drawn carbon nanotube film, a flocculated carbon nanotube film, or a pressed carbon nanotube film.

A film can be drawn from a carbon nanotube array to obtain a drawn carbon nanotube film. Examples of drawn carbon nanotube film are taught by U.S. Pat. No. 7,045,108 to Jiang et al., and WO 2007015710 to Zhang et al. The drawn carbon nanotube film includes a plurality of carbon nanotubes that are arranged substantially parallel to a surface of the drawn carbon nanotube film. A large number of the carbon nanotubes in the drawn carbon nanotube film can be oriented along a preferred orientation, meaning that a large number of the carbon nanotubes in the drawn carbon nanotube film are arranged substantially along the same direction. An end of a carbon nanotube is joined to another end of an adjacent carbon nanotube arranged substantially along the same direction, by van der Waals attractive force. A small number of the carbon nanotubes are randomly arranged in the drawn carbon nanotube film, and has a small, if not negligible, effect on the larger number of the carbon nanotubes in the drawn carbon nanotube film arranged substantially along the same direction. The drawn carbon nanotube film is capable of forming a freestanding structure. The successive carbon nanotubes joined end to end by van der Waals attractive force realizes the freestanding structure of the drawn carbon nanotube film.

Some variations can occur in the orientation of the carbon nanotubes in the drawn carbon nanotube film. Microscopically, the carbon nanotubes oriented substantially along the same direction may not be perfectly aligned in a straight line, and some curve portions may exist. It is noteworthy that a contact between some carbon nanotubes located substantially side by side and oriented along the same direction can not be totally excluded.

More specifically, the drawn carbon nanotube film can include a plurality of successively oriented carbon nanotube segments joined end-to-end by van der Waals attractive force therebetween. Each carbon nanotube segment includes a plurality of carbon nanotubes substantially parallel to each other, and joined by van der Waals attractive force therebetween. The carbon nanotube segments can vary in width, thickness, uniformity, and shape. The carbon nanotubes in the drawn carbon nanotube film are also substantially oriented along a preferred orientation. The thickness of the drawn carbon nanotube film can range from about 0.5 nm to about 100 μm. The width of the drawn carbon nanotube film relates to the carbon nanotube array from which the drawn carbon nanotube film is drawn. If the carbon nanotube structure consists of the drawn carbon nanotube film, and a thickness of the carbon nanotube structure is relatively small (e.g., smaller than 10 μm), the carbon nanotube structure can have a good transparency, and the transmittance of the light can reach about 90%. Thus, the transparent carbon nanotube structure can be used to make a transparent diaphragm 10 with transparent membrane 14.

The carbon nanotube structure can include at least two stacked drawn carbon nanotube films. An angle between the aligned directions of the carbon nanotubes in the two adjacent carbon nanotube films can range from about 0° to about 90° ($0° \leqq \alpha \leqq 90°$). Spaces are defined between two adjacent and side-by-side carbon nanotubes in the drawn carbon nanotube film. When the angle between the aligned directions of the carbon nanotubes in adjacent carbon nanotube films is larger than 0 degrees, the carbon nanotubes define a microporous structure. The carbon nanotube structure in an embodiment employing these films will have a plurality of micropores. A diameter of the micropores can be smaller than about 10 μm. Stacking the carbon nanotube films will add to the structural integrity of the carbon nanotube structure.

The flocculated carbon nanotube film can include a plurality of long, curved, disordered carbon nanotubes entangled with each other. A length of the carbon nanotubes can be larger than 10 μm. In one embodiment, the length of the carbon nanotubes is in a range from about 200 μm to about 900 μm. Further, the flocculated carbon nanotube film can be isotropic. Adjacent carbon nanotubes are acted upon by van der Waals attractive force to obtain an entangled structure with micropores defined therein. The flocculated carbon nanotube film is very porous. Sizes of the micropores can be less than about 10 μm. Because the carbon nanotubes in the carbon nanotube structure are entangled with each other, the carbon nanotube structure employing the flocculated carbon nanotube film has excellent durability, and can be fashioned into desired shapes with a low risk to the integrity of the carbon nanotube structure. The flocculated carbon nanotube film is freestanding because the carbon nanotubes are entangled and adhered together by van der Waals attractive force therebetween. The thickness of the flocculated carbon nanotube film can range from about 1 μm to about 1 mm. In one embodiment, the thickness of the flocculated carbon nanotube film is about 100 μm.

The pressed carbon nanotube film can be a freestanding carbon nanotube film that is formed by pressing a carbon nanotube array down on the substrate. The carbon nanotubes in the pressed carbon nanotube film can be arranged along a same direction or along different directions. The carbon nanotubes in the pressed carbon nanotube film can rest upon each other. Adjacent carbon nanotubes are attracted to each other and are combined by van der Waals attractive force. An angle between a primary alignment direction of the carbon nanotubes and a surface of the pressed carbon nanotube film is about 0 degrees to approximately 15 degrees. The greater the pressure applied, the smaller the angle obtained. If the carbon nanotubes in the pressed carbon nanotube film are arranged along different directions, the carbon nanotube structure can be isotropic. Here, "isotropic" means the carbon nanotube film has properties identical in all directions substantially parallel to a surface of the carbon nanotube film. The thickness of the pressed carbon nanotube film ranges from about 0.5 nm to about 1 mm. The length of the carbon nanotubes can be larger than 50 μm. Clearances can exist in the carbon nanotube array, therefore, micropores exist in the pressed carbon nanotube film and defined by the adjacent carbon nanotubes. Examples of pressed carbon nanotube film are taught by US PGPub. 20080299031A1 to Liu et al.

It is noteworthy that, when the carbon nanotubes of the carbon nanotube structure are aligned along one direction or some predetermined directions, a larger strength and Young's modulus can be achieved along the direction of the carbon nanotubes in the carbon nanotube structure. Therefore, by arranging the carbon nanotube structure such that the carbon nanotubes therein are aligned along a particular direction, the strength and Young's modulus of the diaphragm 10 along this direction can be improved.

The carbon nanotube wire can be untwisted or twisted. Treating the drawn carbon nanotube film with a volatile organic solvent can obtain the untwisted carbon nanotube wire. In one embodiment, the organic solvent is applied to soak the entire surface of the drawn carbon nanotube film. During the soaking, adjacent substantially parallel carbon nanotubes in the drawn carbon nanotube film will bundle together, due to the surface tension of the organic solvent as it volatilizes, and thus, the drawn carbon nanotube film will be shrunk into an untwisted carbon nanotube wire. The untwisted carbon nanotube wire includes a plurality of carbon nanotubes substantially oriented along a same direction (i.e., a direction along the length direction of the untwisted carbon nanotube wire). The carbon nanotubes are substantially parallel to the axis of the untwisted carbon nanotube wire. In one embodiment, the untwisted carbon nanotube wire includes a plurality of successive carbon nanotubes joined end to end by van der Waals attractive force therebetween. The length of the untwisted carbon nanotube wire can be arbitrarily set as desired. A diameter of the untwisted carbon nanotube wire ranges from about 0.5 nm to about 100 μm.

The twisted carbon nanotube wire can be obtained by twisting a drawn carbon nanotube film using a mechanical force to turn the two ends of the drawn carbon nanotube film in opposite directions. The twisted carbon nanotube wire includes a plurality of carbon nanotubes helically oriented around an axial direction of the twisted carbon nanotube wire. In one embodiment, the twisted carbon nanotube wire includes a plurality of successive carbon nanotubes joined end to end by van der Waals attractive force therebetween. The length of the carbon nanotube wire can be set as desired. A diameter of the twisted carbon nanotube wire can be from about 0.5 nm to about 100 μm.

The carbon nanotube wire is a freestanding structure. The length direction of the carbon nanotube wire has a larger strength and Young's modulus. Therefore, by arranging the carbon nanotube wire such that the carbon nanotube wire is aligned along a particular direction, the strength and Young's modulus of the diaphragm 10 along this direction can be improved.

Referring to FIGS. 8 to 12, in a second embodiment, the reinforcing structure 22 of the diaphragm 20 includes a carbon nanotube structure 220 and an additional reinforcing member 260. The carbon nanotube structure 220 and the additional reinforcing member 260 can be combined or composite together to form a composite reinforcing member. The material of the additional reinforcing member 260 is not carbon nanotubes. The carbon nanotube structure 220 can be at least one carbon nanotube wire structure and/or at least one carbon nanotube film as described above in the first embodiment. The reinforcing member 260 can include at least one of a linear shaped reinforcing member and a planar shaped reinforcing member.

Figure 8:
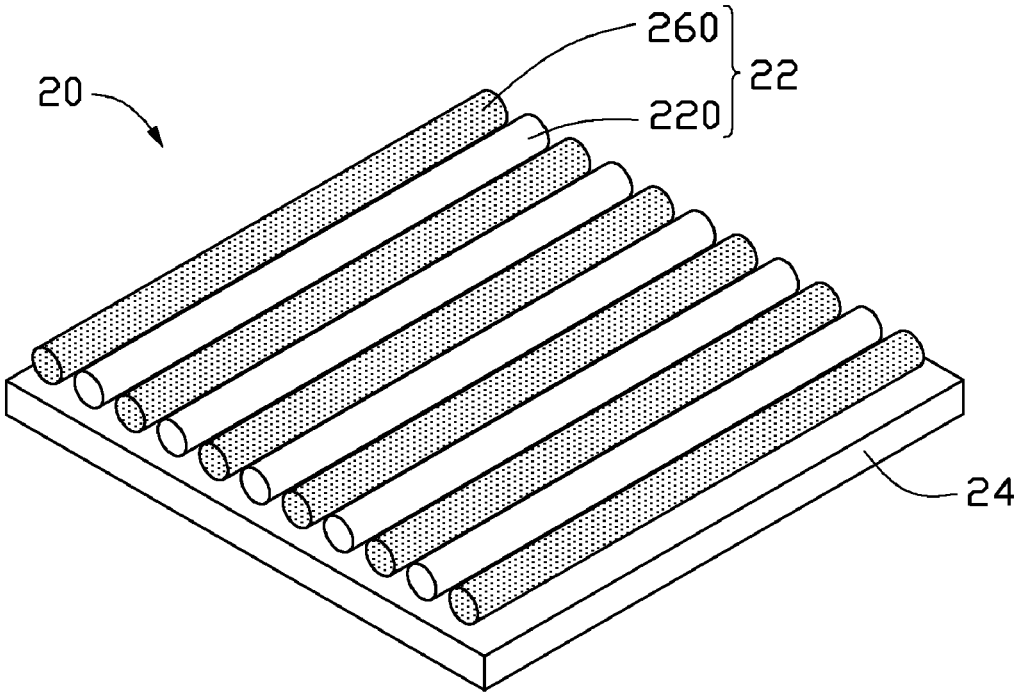
FIG. 8 is a schematic structural view of another embodiment of a diaphragm including a plurality of carbon nanotube wire structures and a plurality of reinforcing wire structures parallel to the plurality of carbon nanotube wire structures.
Figure 9:
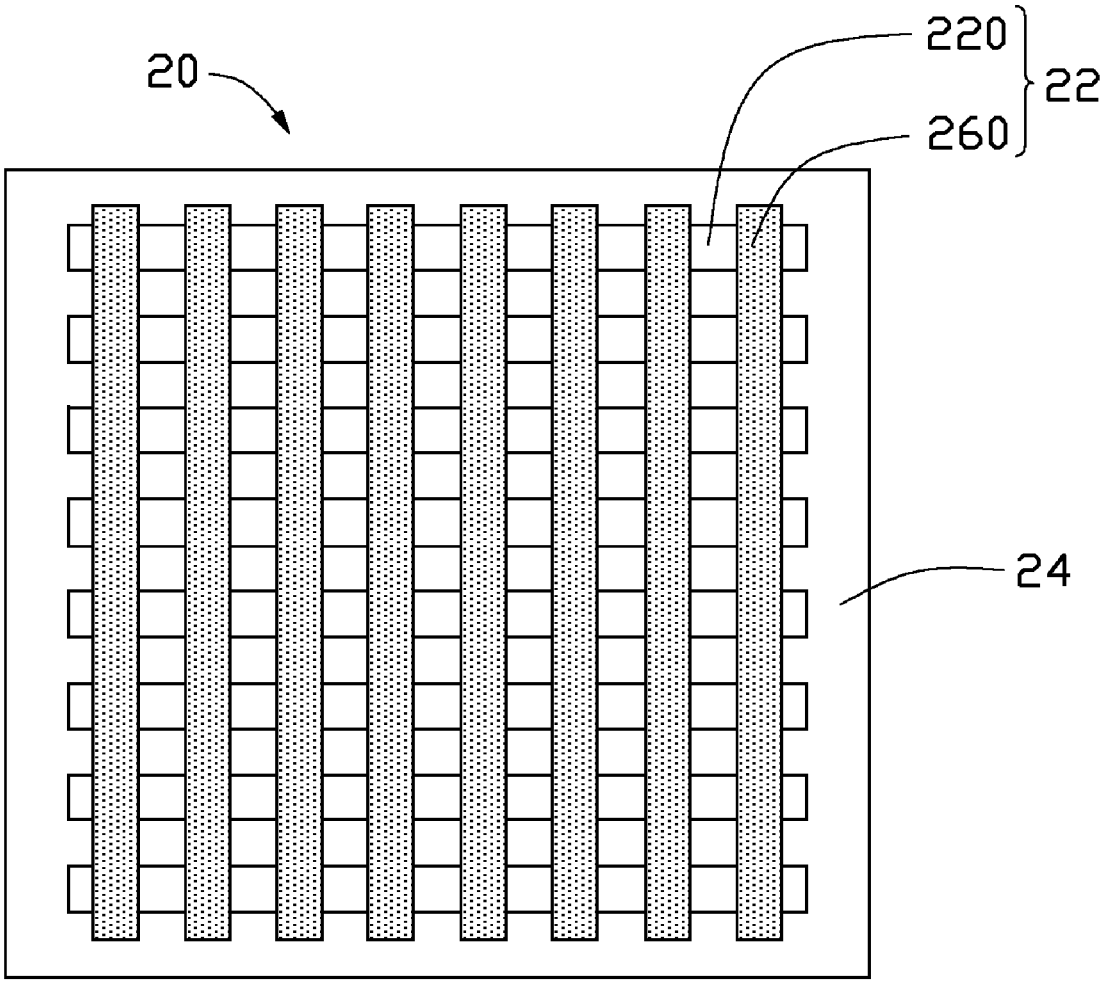
FIG. 9 is a schematic top view of another embodiment of a diaphragm including a plurality of carbon nanotube wire structures and a plurality of reinforcing wire structures perpendicular to the plurality of carbon nanotube wire structures.
Figure 10:
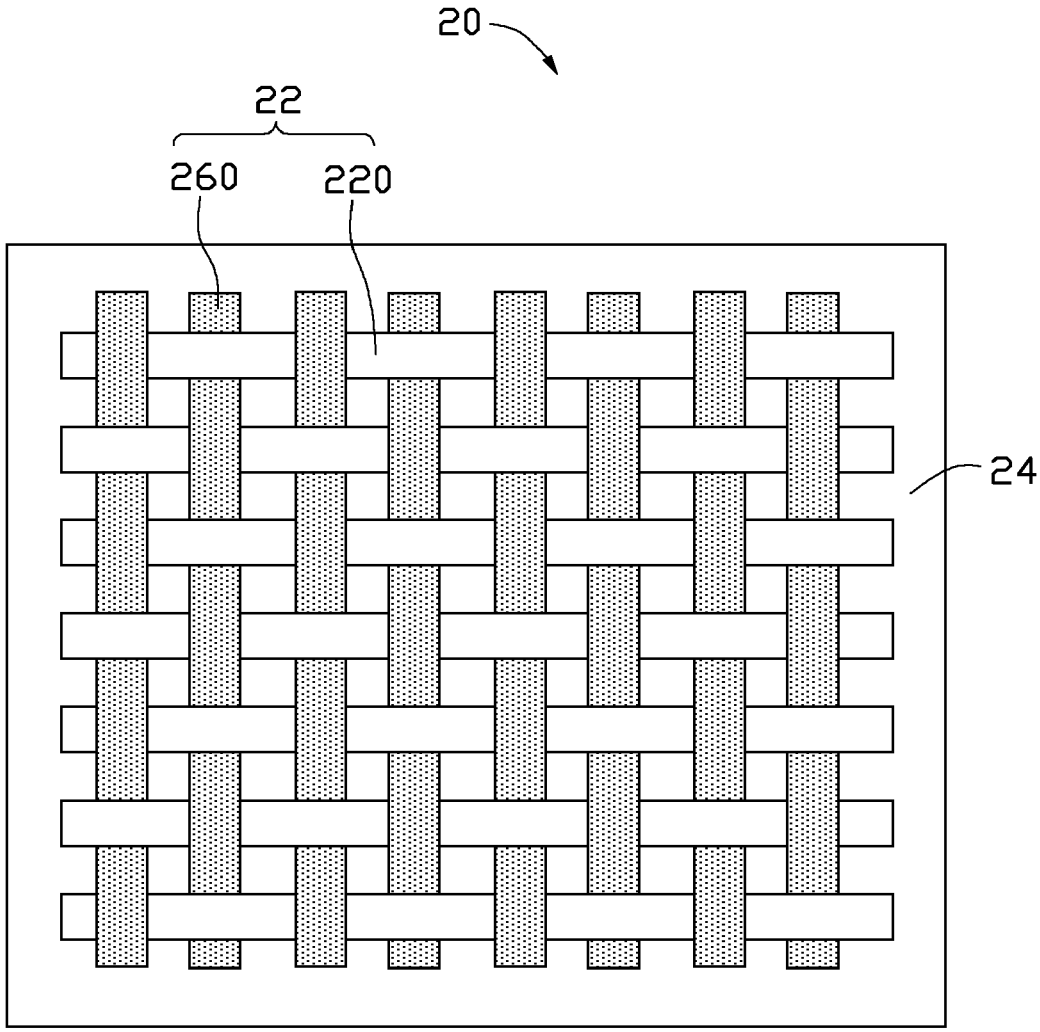
FIG. 10 is a schematic top view of another embodiment of a diaphragm including a plurality of carbon nanotube wire structures and a plurality of reinforcing wire structures woven together.

The reinforcing structure 22 can include a plurality of carbon nanotube wire structures 220 and a plurality of linear shaped reinforcing members 260. Referring to FIGS. 8 to 10, in the diaphragm 20, the plurality of the carbon nanotube wire structures 220 and the plurality of the linear shaped reinforcing members 260 can be substantially parallel to each other, crossed with each other, or woven together, to form the planar shaped reinforcing structure 22 disposed on one surface of the membrane 24. As shown in FIG. 8, the carbon nanotube wire structures 220 and the reinforcing members 260 are alternatively juxtaposed on the surface of the membrane 24. The carbon nanotube wire structures 220 contact adjacent reinforcing members 260. The axes of the carbon nanotube wire structures 220 and the reinforcing members 260 are oriented in the same direction. As shown in FIG. 9, the carbon nanotube wire structures 220 are arranged substantially parallel at regular intervals to form a layer covering the surface of the membrane 24. The reinforcing members 260 are arranged substantially parallel at regular intervals to form a layer covering the layer of the carbon nanotube wire structures 220. The axes of the carbon nanotube wire structures 220 are oriented to a first direction, and the axes of the reinforcing members 260 are oriented to a second direction substantially perpendicular to the first direction.

The linear shaped reinforcing member 260 can be at least one of cotton wires, fibers, polymer wires, and metal wires. The planar shaped reinforcing member can be at least one of polymer films, carbon fiber films, fabrics, and papers. The plurality of the carbon nanotube wire structures 220 and the plurality of the linear shaped reinforcing members 260 can be woven together to form a carbon nanotube composite cloth. The carbon nanotube composite cloth can be used as the reinforcing structure 22 disposed on one surface of the membrane 24. The reinforcing structure 22 can include a combination of at least one of the carbon nanotube film and the carbon nanotube wire structure 220 and at least one of the linear shaped reinforcing members 260 and planar shaped reinforcing member. The carbon nanotube film and the linear shaped reinforcing member 260 or planar shaped reinforcing member can be stacked together. In other embodiments, the linear shaped reinforcing member 260 can be substantially parallelly arranged, crossed with each other, woven together, or coiled, and disposed on the surface of the carbon nanotube film.

Figure 11:
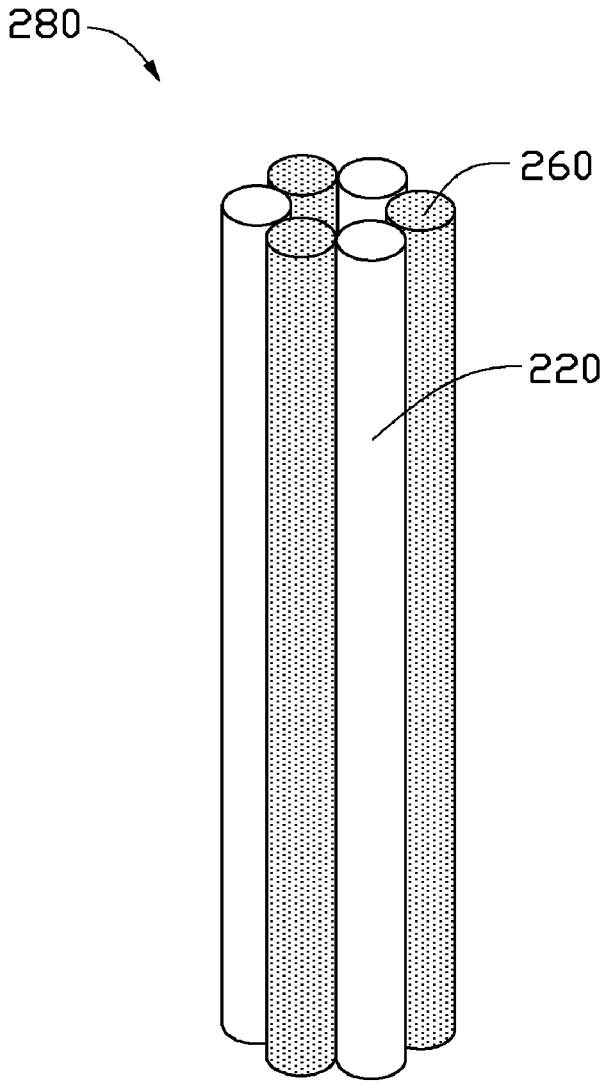
FIG. 11 is a schematic structural view of a carbon nanotube composite wire structure including a plurality of carbon nanotube wire structures and a plurality of reinforcing wire structures parallel to each other.
Figure 12:
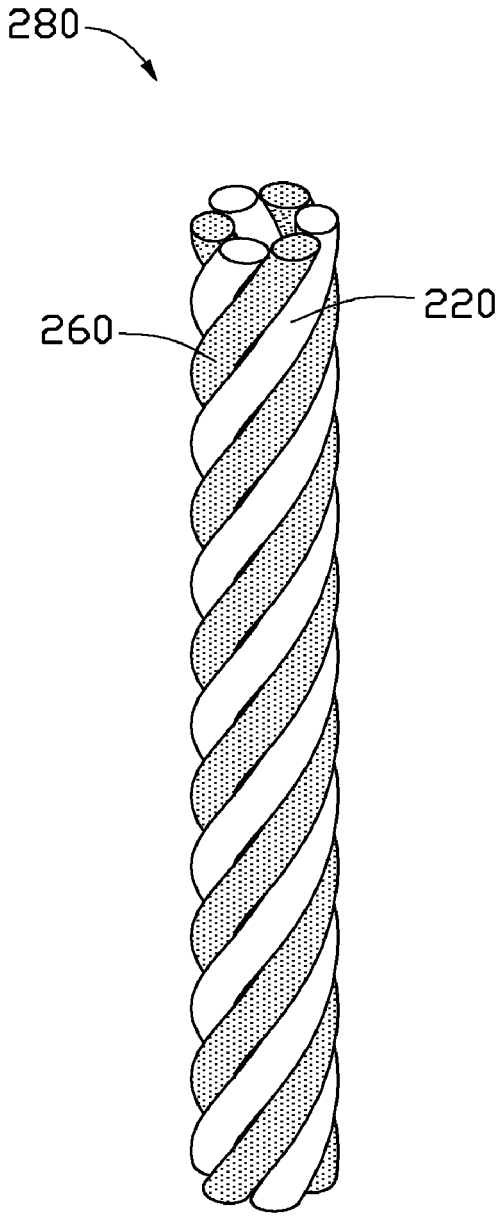
FIG. 12 is a schematic structural view of a carbon nanotube composite wire structure including a plurality of carbon nanotube wire structures and a plurality of reinforcing wire structures twisted together.

Referring to FIGS. 11 to 12, the reinforcing structure 22 can include at least one composite wire 280. The composite wire 280 can include at least one carbon nanotube wire structure 220 and at least one linear shaped reinforcing member 260. The carbon nanotube wire structure 220 and the linear shaped reinforcing member 260 can be substantially parallelly arranged to form a bundle-shaped structure or twisted together to form a twisted wire. The composite wire 280 can be arranged on one surface of the membrane 24 as the same manner as the carbon nanotube wire structure 120 in the first embodiment.

In a third embodiment, the reinforcing structure includes a carbon nanotube composite structure to replace the carbon nanotube structure in the first and second embodiments. The carbon nanotube composite structure is a composite of the carbon nanotube structure and other materials. The carbon nanotube structure can be at least one of the carbon nanotube film 122 or the carbon nanotube wire structure 120.

Figure 13:
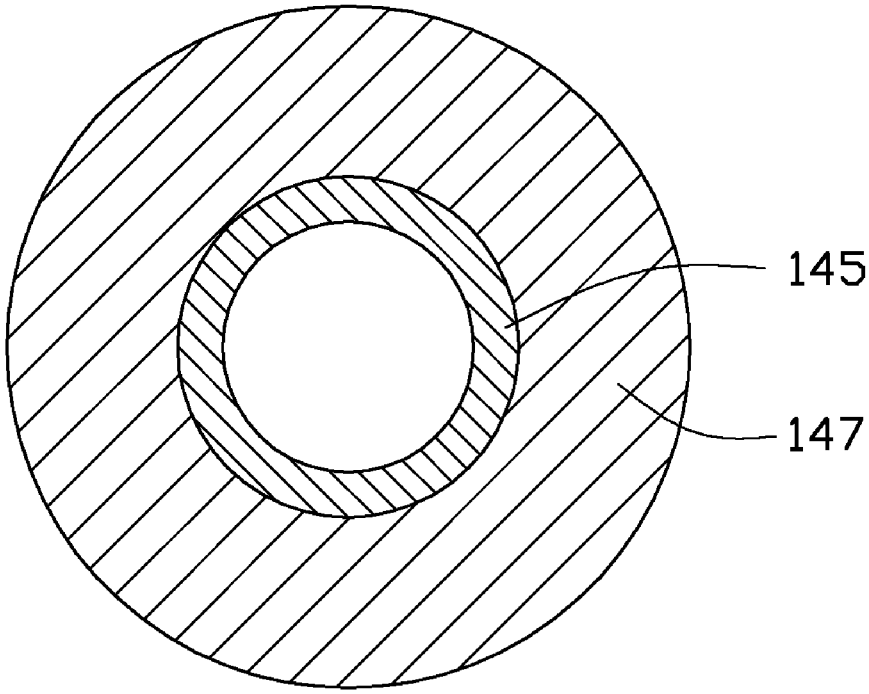
FIG. 13 is a cross-sectional view of a single carbon nanotube with a coating layer on the sidewall thereof.

Referring to FIG. 13, in the carbon nanotube composite structure, each carbon nanotube 145 is individually covered by a coating layer 147 formed from other materials. The other materials can be at least one of metal, diamond, boron carbide, or ceramic. The metal can be at least one of iron (Fe), cobalt (Co), nickel (Ni), palladium (Pd), titanium (Ti), copper (Cu), silver (Ag), gold (Au), platinum (Pt), or any combination thereof. The thickness of coating layer 147 can be ranged from about 1 nanometer to about 100 nanometers. In one embodiment, the thickness of the coating layer 147 can be less than about 20 nanometers. The carbon nanotube wire structure and the carbon nanotube film have a plurality of micropores. Therefore, other materials can be formed on the outer surface of the side-wall of the individual carbon nanotube to form the coating layer 147 by a method such as PVD, CVD, evaporation, sputtering, electroplating, and chemical plating. A plurality of covering layers 147 can be formed on the outer surface of the carbon nanotube 145 in a concentric manner.

Figure 14:
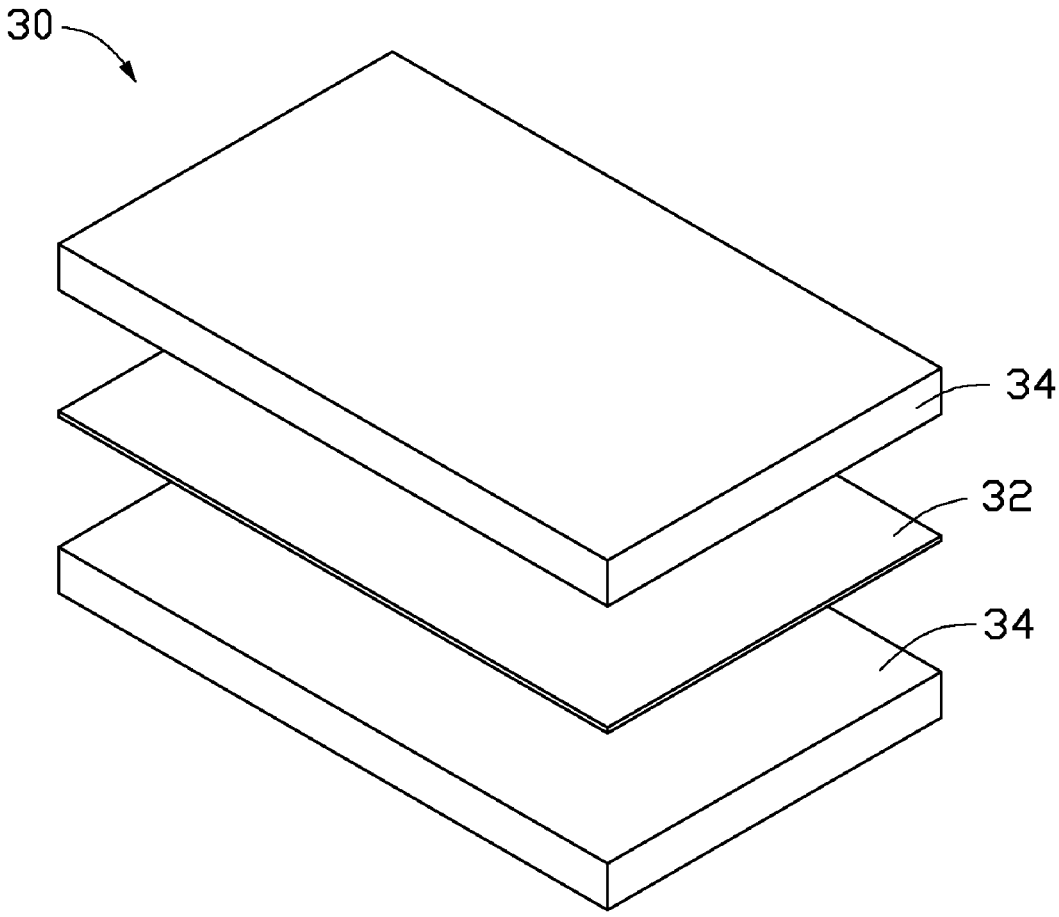
FIG. 14 is similar to FIG. 1, with the addition of another membrane.

Referring to FIG. 14, in a fourth embodiment, a diaphragm 30 includes two membranes 34 and one reinforcing structure 32. The reinforcing structure 32 can be one of the reinforcing structures of the aforementioned embodiments. The membranes 34 can be one of the membranes of the aforementioned embodiments. The reinforcing structure 32 is sandwiched by the membranes 34. The reinforcing structure 32 can be placed at areas between the membranes 34 that need reinforcement. In one embodiment, opposite surfaces of the reinforcing structure 32 can be directly attached to the membranes 34 in a one-to-one manner via the adhesive nature of the reinforcing structure 32. Opposite surfaces of the reinforcing structure 32 can also be attached to the membranes 34 via adhesive. The membranes 34 and the reinforcing structure 32 can be further treated by hot pressing, so that the reinforcing structure 32 and the membranes 34 can be firmly combined together.

In other embodiments, the diaphragm 30 can also include a plurality of membranes 34 alternately stacked with a plurality of reinforcing structures 32.

It is noteworthy that although the diaphragms 10, 20, 30 shown in FIGS. 1, 8, 14, have a rectangular shape, the diaphragms 10, 20, 30 can be cut into other shapes, such as circular, elliptical, or triangular, depending on the loudspeaker. The shape of the diaphragms 10, 20, 30 is not limited.

Figure 15:
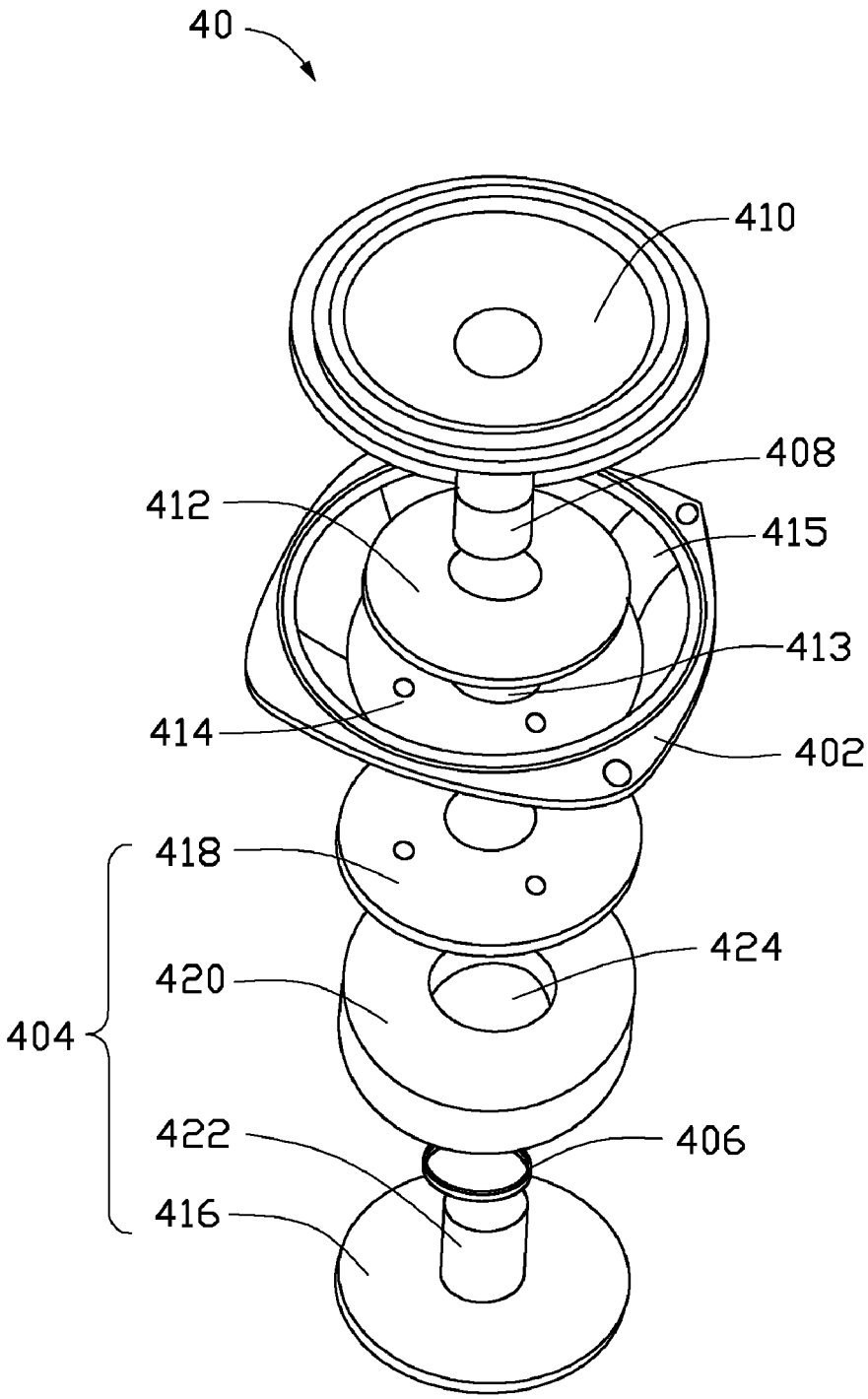
FIG. 15 is a schematic structural view of an embodiment of a loudspeaker.
Figure 16:
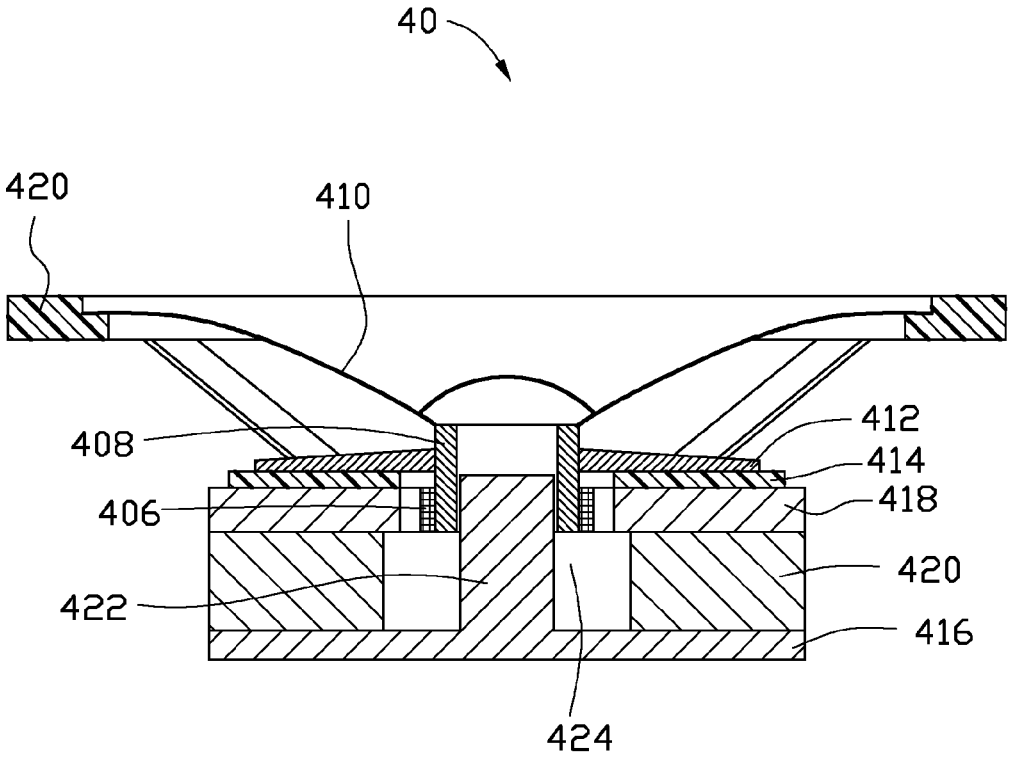
FIG. 16 is a cross-sectional view of the loudspeaker of FIG. 15.

Referring to FIG. 15 and FIG. 16, a loudspeaker 40 using one of the diaphragms 10, 20, 30 of the aforementioned first, second, third or forth embodiments, includes a frame 402, a magnetic circuit 404, a voice coil 406, a bobbin 408, a diaphragm 410, and a damper 412. The diaphragm 410 can be one of the aforementioned diaphragms 10, 20, 30.

The frame 402 is mounted on one side of the magnetic circuit 404. The voice coil 406 is received in the magnetic circuit 404. The voice coil 406 winds up on the bobbin 408. An outer rim of the diaphragm 410 is fixed to an inner rim of the frame 402, and an inner rim of the diaphragm 410 is fixed to an outer rim of the bobbin 408 placed in a magnetic gap 424 of the magnetic circuit 404.

The frame 402 can be a truncated cone with an opening on one end and includes a hollow cavity 415 and a bottom 414. The hollow cavity 415 receives the diaphragm 410 and the damper 412. The bottom 414 has a center hole 413 to accommodate the center pole 422 of the magnetic circuit 404. The bottom 414 of the frame 402 is fixed to the magnetic circuit 404.

The magnetic circuit 404 includes a lower plate 416 having a center pole 422, an upper plate 418, and a magnet 420. The magnet 420 is sandwiched by the lower plate 416 and the upper plate 418. The upper plate 418 and the magnet 420 are both a circle, and define a cylinder shaped space in the magnet circuit 404. The center pole 422 is accepted in the cylinder shaped space and goes through the center hole 413. The magnetic gap 424 is formed by the center pole 422 and the magnet 420. The magnetic circuit 404 is fixed on the bottom 414 at the upper plate 418.

The voice coil 406 wound on the bobbin 408 is a driving member of the loudspeaker 40. The voice coil 406 is made of conducting wire. When an electric signal inputted into the voice coil 406, a magnetic field can be formed by the voice coil 406 by the variation of the electric signal. The interacting of the magnetic field caused by the voice coil 406 and the magnetic circuit 404 produce the vibration of the voice coil 406.

The bobbin 408 is light in weight and has a hollow structure. The center pole 422 is disposed in the hollow structure and spaced from the bobbin 408. When the voice coil 406 vibrates, the bobbin 408 and the diaphragm 410 also vibrate with the voice coil 406 to produce sound.

The diaphragm 410 is a sound producing member of the loudspeaker 40. The diaphragm 410 can have a cone shape when using in the large sized loudspeaker 40. When the loudspeaker 40 has a smaller size, the diaphragm 410 can have a planar round shape or a planar rectangle shape.

The damper 412 is a substantially ring-shaped plate having radially alternate circular ridges and circular furrows. The damper 412 holds the diaphragm 410 mechanically. The damper 412 is fixed to the frame 402 and the bobbin 408. The damper 412 has a relatively large rigidity along the radial direction thereof, and a relatively small rigidity along the axial direction thereof, thus allowing the voice coil to move up and down freely but not radially.

Furthermore, an external input terminal can be attached to the frame 402. A dust cap can be fixed over and above a joint portion of the diaphragm 410 and the bobbin 408.

It is to be understood that, the loudspeaker 40 is not limited to the above-described structure. Any loudspeaker using the present diaphragm is in the scope of the present disclosure.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A diaphragm comprising at least one membrane and at least one reinforcing structure stacked on the at least one membrane, the at least one reinforcing structure comprising at least one carbon nanotube structure, wherein the at least one carbon nanotube structure is a free-standing structure.

2. The diaphragm of claim 1, wherein the at least one membrane comprises a plurality of membranes, and the at least one reinforcing structure comprises a plurality of reinforcing structures, each of the plurality of reinforcing structures comprises at least one carbon nanotube structure, the membranes and the reinforcing structures are stacked on each other in an alternating manner.

3. The diaphragm of claim 1, wherein the at least one carbon nanotube structure comprises at least one carbon nanotube film, at least one carbon nanotube wire structure, or a combination of the at least one carbon nanotube film and the at least one carbon nanotube wire structure.

4. The diaphragm of claim 3, wherein the at least one carbon nanotube film comprises a plurality of carbon nanotubes substantially parallel to a surface of the at least one carbon nanotube film, the plurality of the carbon nanotubes are joined end-to-end by van der Waals attractive force therebetween and substantially aligned along a same direction.

5. The diaphragm of claim 3, wherein the at least one carbon nanotube wire structure comprises a carbon nanotube wire, a plurality of carbon nanotube wires substantially parallel to each other, or a plurality of carbon nanotube wires twisted together.

6. The diaphragm of claim 5, wherein each of the carbon nanotube wires comprises a plurality of carbon nanotubes joined end to end by van der Waals attractive force therebetween.

7. The diaphragm of claim 3, wherein the at least one carbon nanotube film comprises a plurality of carbon nanotube films stacked together or coplanar arranged.

8. The diaphragm of claim 3, wherein the at least one carbon nanotube wire structure is arranged on a surface of the at least one membrane and has a spiral shape.

9. The diaphragm of claim 3, wherein the at least one carbon nanotube wire structure comprises a plurality of carbon nanotube wire structures substantially parallel to each other, crossed with each other, or woven together.

10. The diaphragm of claim 3, wherein the at least one carbon nanotube wire structure is arranged to form a circular shape on the at least one membrane.

11. The diaphragm of claim 3, wherein the at least one carbon nanotube wire structure comprises a plurality of carbon nanotube wire structures arranged radially on the at least one membrane.

12. The diaphragm of claim 1, wherein the at least one carbon nanotube structure comprises a plurality of carbon nanotubes and a coating layer individually located on each of the carbon nanotubes.

13. The diaphragm of claim 12, wherein a material of the coating layer is selected from the group consisting of metal, diamond, boron carbide, ceramic, and combinations thereof.

14. The diaphragm of claim 1, wherein the at least one reinforcing structure further comprises at least one reinforcing member.

15. The diaphragm of claim 14, wherein the at least one reinforcing member comprises at least one linear shaped reinforcing member, at least one planar shaped reinforcing member, or a combination of the at least one linear shaped reinforcing member and the at least one planar shaped reinforcing member.

16. The diaphragm of claim 15, wherein the at least one linear shaped reinforcing member is substantially parallel to, crossed with, or woven together with the at least one carbon nanotube structure.

17. The diaphragm of claim 15, wherein the at least one planar shaped reinforcing member is stacked with the at least one carbon nanotube structure.

18. The diaphragm of claim 1, wherein the at least one reinforcing structure is directly attached on the at least one membrane.

19. A loudspeaker comprising:

a magnetic circuit defining a magnetic gap;

a bobbin located in the magnetic gap;

a voice coil wound on the bobbin; and a diaphragm fixed to the bobbin, wherein the diaphragm comprises a membrane and at least one reinforcing structure disposed on at least one outer surface of the membrane, the at least one reinforcing structure comprises at least one carbon nanotube structure, wherein the at least one carbon nanotube structure is a free-standing structure.

20. The loudspeaker of claim 19, wherein the at least one carbon nanotube structure comprises a net structure of a plurality of carbon nanotubes combined to each other by van der Waals attractive force, and the at least one reinforcing structure and the membrane are transparent.

* * * * *